US005902037A

United States Patent [19]

Turner et al.

[11] Patent Number: 5,902,037

[45] Date of Patent: May 11, 1999

[54] LAMP WITH SAFETY FEATURES

[75] Inventors: Thomas M. Turner, Whitingsville, Mass.; Robert J. Livergood, Wilmington, Vt.; David Lo, San Chung, Taiwan

[73] Assignee: Holmes Products Corp., Milford, Mass.

[21] Appl. No.: 08/794,605

[22] Filed: Feb. 3, 1997

Related U.S. Application Data

[63] Continuation-in-part of application No. 08/711,242, Sep. 9, 1996.

[51] Int. Cl.[6] ..... F21V 15/02

[52] U.S. Cl. ..... 362/376; 362/395; 362/414; 362/450

[58] Field of Search ..... 362/294, 295, 362/394, 395, 410, 411, 414, 802, 376, 377, 378, 449, 450, 444, 445, 440; 361/105

[56] References Cited

U.S. PATENT DOCUMENTS

| | | | |
|---|---|---|---|
| D. 350,213 | 8/1994 | Druffel et al. . | |
| D. 368,548 | 4/1996 | Lee . | |
| 1,349,392 | 8/1920 | Tillson | 362/378 |
| 1,670,566 | 5/1928 | Brown . | |
| 1,830,578 | 11/1931 | Vaughan . | |
| 3,033,982 | 5/1962 | Burns | 362/376 |
| 3,162,377 | 12/1964 | Ozeki | 362/450 |
| 4,450,512 | 5/1984 | Kristofek | 362/802 |
| 4,635,172 | 1/1987 | Steinke | 362/294 |
| 4,685,037 | 8/1987 | Akiyama et al. | 362/294 |
| 4,694,223 | 9/1987 | Campolo . | |
| 4,740,861 | 4/1988 | Droho et al. | 361/105 |
| 4,751,623 | 6/1988 | Gaines et al. | 362/802 |
| 4,751,624 | 6/1988 | Russo et al. | 362/802 |
| 4,835,667 | 5/1989 | Wolfe | 362/295 |
| 4,930,054 | 5/1990 | Krebs | 362/295 |
| 4,980,809 | 12/1990 | Baldwin et al. | 362/802 |
| 5,023,744 | 6/1991 | Hofsäss . | |
| 5,101,333 | 3/1992 | Glassford | 362/395 |
| 5,157,579 | 10/1992 | Brenner et al. | 362/295 |
| 5,165,785 | 11/1992 | Doong . | |
| 5,177,658 | 1/1993 | Brenner et al. | 362/295 |
| 5,221,141 | 6/1993 | Swanson | 362/414 |
| 5,321,576 | 6/1994 | Brenner et al. | 362/295 |
| 5,528,448 | 6/1996 | Brenner et al. | 362/295 |
| 5,718,506 | 2/1998 | Yeh | 362/410 |
| 5,720,549 | 2/1998 | Lavy | 362/414 |
| 5,725,303 | 3/1998 | Lin | 362/376 |

FOREIGN PATENT DOCUMENTS

| | | |
|---|---|---|
| 1525219 | 4/1967 | France . |
| 603893 | 9/1934 | Germany . |

OTHER PUBLICATIONS

U.S. Consumer Product Safety Commission, News From CPSC, Jul. 1996.

Underwriters Laboratories, On the MARK, Sep. 1996.

Underwriters Laboratories, "UL Urges Consumers . . . ", Apr. 1996.

*Primary Examiner*—Stephen Husar

*Attorney, Agent, or Firm*—Hoffmann & Baron, LLP; Francis E. Marino

[57] ABSTRACT

A lamp with improved safety features to avoid fire and burn hazards. The lamp includes an electrical circuit having a thermostat connected in series with the bulb of the lamp. The thermostat is mounted in close proximity to the lamp's bulb and, upon the ambient air temperature in the vicinity of the thermostat reaching a predetermined temperature, the thermostat effectively opens the electrical circuit, shutting the lamp off. Once power is turned off for a period of time, the thermostat resets and the lamp may be operated again. A protective guard is positioned over at least a portion of the bulb of the lamp to prevent accidental burning.

15 Claims, 12 Drawing Sheets

LAMP WITH SAFETY FEATURES

The present application is a continuation-in-part of copending U.S. application Ser. No. 08/711,242 filed Sep. 9, 1996.

BACKGROUND OF THE INVENTION

1. Field of the Invention

The present invention relates to a lamp generally and, more particularly, to an improved floor lamp having safety features to prevent risk of fire and injury to persons.

2. Description of the Prior Art

Presently available standing floor lamps and, more particularly, lamps commonly referred to as "torchiere" halogen floor lamps, are known to produce a significant amount of heat from the 300 watt halogen light bulbs used therein. The heat of these light bulbs is a potential fire hazard as well as a burn hazard to persons coming in contact with the top portion or shade of the torchiere lamp or the halogen bulb itself.

Generally, manufacturers of these types of lamps provide warnings to the consumers with respect to potential fire and injury hazards which may be caused by extremely hot halogen lamps. Such warnings may include a tag attached to the power supply cord or a label attached to the inside of the shade near the halogen bulb to warn consumers of the potential burn hazard when changing a halogen bulb. To date, no manufacturer of torchiere style lamps provides any sort of built-in safety feature to protect the consumer from risk of fire or injury due to burns. Accordingly, the present invention is directed to providing safety features for the halogen torchiere style lamps to provide protection to the consumer against risk of fire and injury.

OBJECTS AND SUMMARY OF THE INVENTION

It is an object of the present invention to provide a lamp which includes safety features to prevent potential fire hazards.

It is another object of the present invention to provide a lamp having means for preventing a person from contacting the halogen bulb and risking possible injury due to burning and to prevent objects from coming in contact with the halogen bulb to prevent potential fire hazards.

It is yet a further object of the invention to provide a lamp having a thermostatic control which is responsive to ambient temperature in the vicinity of an operating lamp which terminates power to the lamp upon reaching a predetermined temperature.

It is still a further object of the present invention to provide a lamp having a thermostatic safety feature in which the thermostat will not reset until power to the lamp is terminated for a period of time.

In accordance with one form of the present invention, an electric lamp includes a base for supporting the lamp and a stem portion having a first end coupled to the base and the second end coupled to a light bulb socket. The electric lamp further includes an electrical circuit for providing power to the light bulb socket, the circuit including an on/off switch and a thermostatic switch serially connected to the light bulb socket. The thermostatic switch is responsive to ambient air temperature such that, upon reaching a predetermined value, power to the light bulb socket is terminated or shut off. Preferably, the thermostatic switch includes a means for maintaining the switch in an open circuit position until power to the lamp is turned off for a period of time to allow the thermostatic switch to reset thereby permitting normal operation of the lamp. The means for maintaining the thermostatic switch may be in the form of a resistive heating element. When the thermostatic switch opens in response to ambient air temperature reaching the predetermined value, current is directed to the resistive heating element which maintains the ambient air temperature in the vicinity of the thermostatic switch above the predetermined value thereby preventing the thermostatic switch from resetting. Only upon termination of power to the lamp, e.g., turning the on/off switch to the off position or unplugging the lamp, will the thermostatic switch be allowed to cool down and reset.

Although the thermostatic switch and resistive heating element may each take many forms, the preferred embodiment of the present invention includes a thermostatic switch which is a bimetallic switch and a ceramic resistive heating element.

In order to provide a margin of safety with respect to fire hazards and potential personal injury, the predetermined temperature at which the thermostatic switch opens the electrical circuit is about 65° C. Furthermore, the thermostatic switch is preferably mounted in close proximity to the light bulb socket to sense the ambient air temperature in the hottest region of the lighting fixture.

Although the present invention may be used with any type of lamp, the safety features of the present invention are particularly useful with respect to halogen torchiere floor lamps. Such lamps use high intensity halogen bulbs, usually 300 watts. These lamps create significant heat and potential fire and personal injury hazards. These types of lamps usually include a bowl-shaped shade provided at the second end of the stem. To direct light in an upward direction, the shade includes positioned therein a reflector. Such lamps also include a dimmer means for controlling the intensity of illumination provided by the lamp.

The present invention also discloses a halogen torchiere floor lamp including a base for supporting the lamp, an elongated hollow stem having a first end coupled to the base and a shade coupled to the second end, a light socket positioned within the shade for receiving a halogen bulb and an electrical circuit means for providing power to the lamp. The halogen floor lamp further includes a protective guard mounted within an interior portion of the shade. The protective guard is positioned over at least a portion of the halogen bulb mounted within the light socket thereby obstructing access to the light socket and bulb with minimal obstruction of light. The protective guard is preferably a convex-shaped wire, but it is envisioned that the protective guard may take many different forms. The halogen floor lamp may also include a reflector located in a bottom portion of the shade and wherein the protective guard is mounted to opposite edges of the reflector.

The present invention also discloses a method of controlling the heat generated by a lighting fixture, the method including the steps of: providing an electrical circuit for a lighting fixture, the circuit including a thermostat serially connected with a light socket, the thermostat being responsive to ambient air temperature in the vicinity of an illuminated bulb within the light socket; sensing the ambient air temperature in the vicinity of the illuminated bulb until a predetermined temperature is reached; opening the circuit thereby extinguishing the light in response to the thermostat being subjected to the predetermined temperature. The method further includes the step of maintaining the open circuit until the power to the lighting fixture is turned off for a period of time allowing the thermostat to reset.

A preferred form of the standing floor lamp, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENTS

Figure 1:
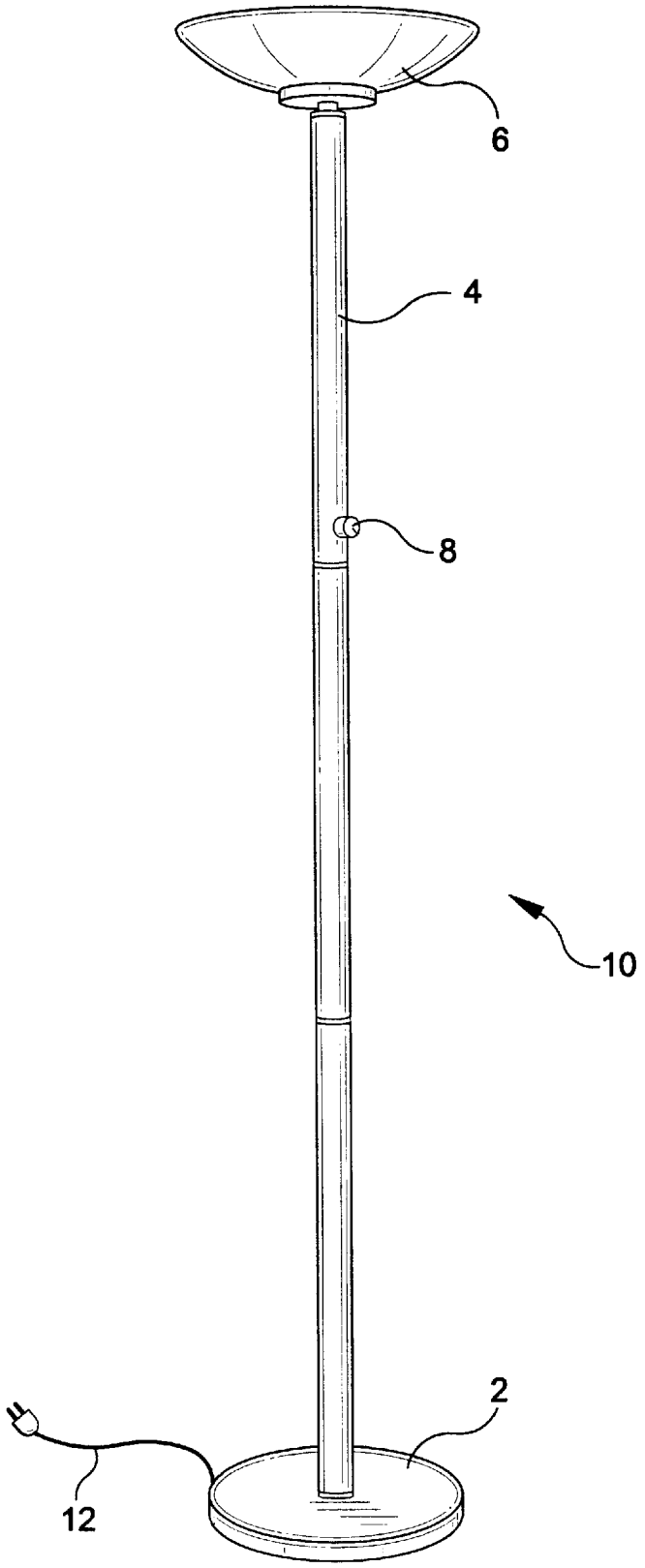
FIG. 1 is a perspective view of a standing floor lamp formed in accordance with the present invention.

The invention relates to safety features for lamps and, more particularly, for halogen torchiere-type standing floor lamps. Although the present invention is described herein for use with a torchiere lamp, it is envisioned that these safety features could be used in conjunction with any type of lighting fixture. As illustrated in FIG. 1, a torchiere lamp 10 formed in accordance with the present invention includes a lamp base 2 for supporting the fixture, an elongated stem 4 having a first end attached to a central portion of the base 2 and a second end coupled to a bowl-shaped shade 6. The stem is hollow and includes a rotary switch 8 for controlling the on/off function of the power supply to the lamp. Furthermore, the switch 8 has associated therewith a dimmer switch for controlling the intensity of the lamp in the on position. Lastly, the lamp includes a power cord 12 which can be plugged into any standard AC electrical outlet.

Figure 2:
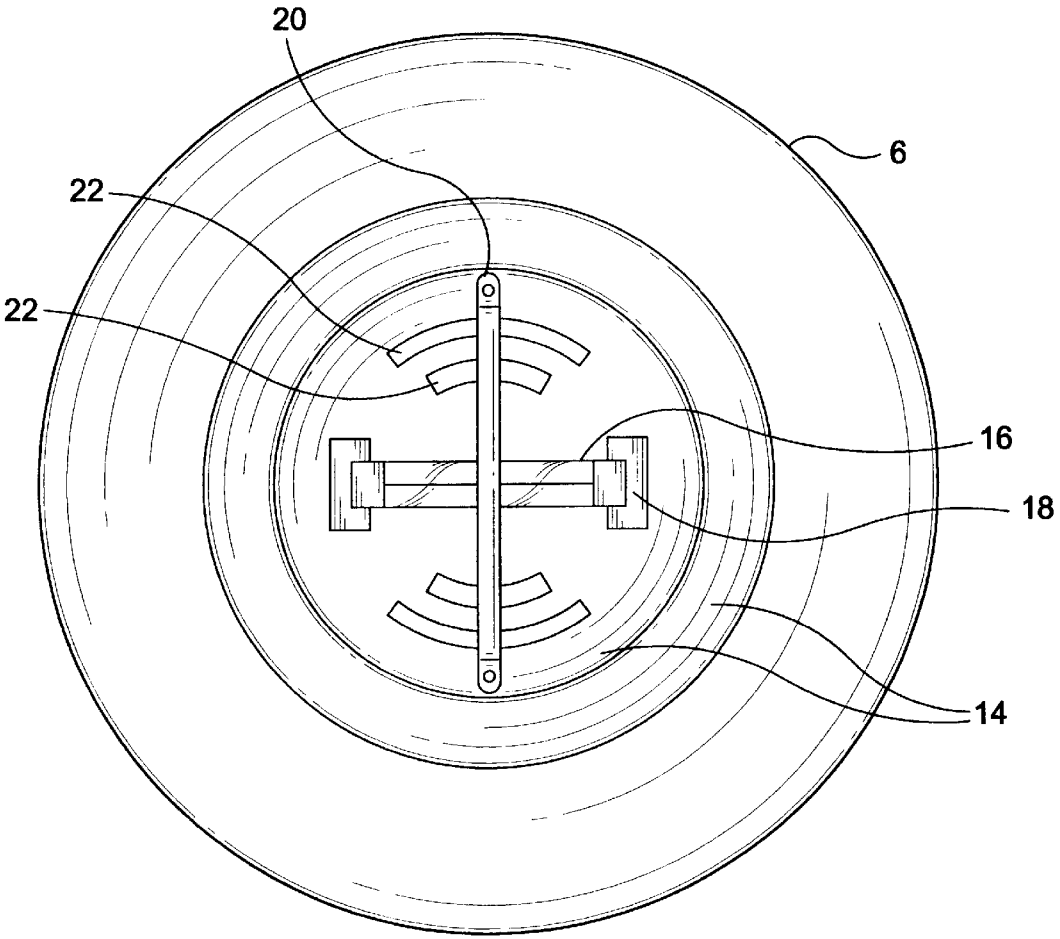
FIG. 2 is a top plan view of the standing floor lamp formed in accordance with the present invention.

FIG. 2 is a top plan view of the shade portion 6 of the lamp formed in accordance with the present invention. Within the shade portion of the lamp there is a reflector 14 which substantially reflects the light from the lamp in an upward direction. Positioned within the reflector is the halogen bulb 16 which is seated within a socket 18. The socket 18 is electrically connected to the rotary switch 8 and ultimately the power source through power cord 12. The reflector formed in accordance with the present invention includes several slots 22 through the thickness thereof. Lastly, FIG. 2 illustrates a top view of a protective guard 20 which is positioned across and over at least a portion of the halogen bulb and mechanically connected to edges of the reflector 14.

Figure 5:
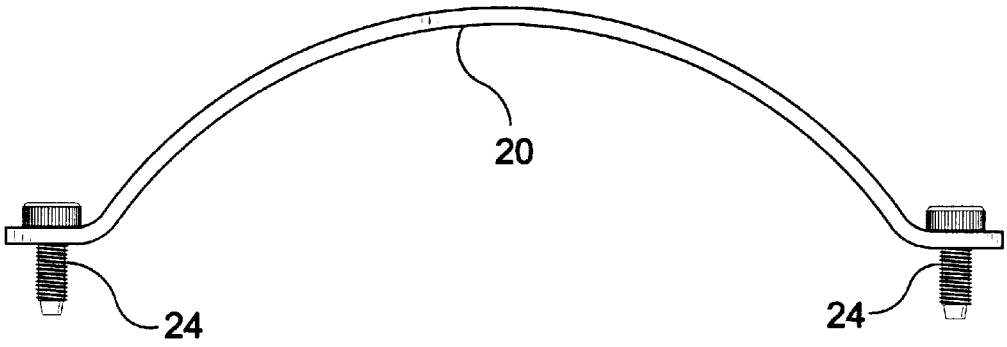
FIG. 5 is a side view of the protective guard shown in FIG. 2 formed in accordance with the present invention.
Figure 6:
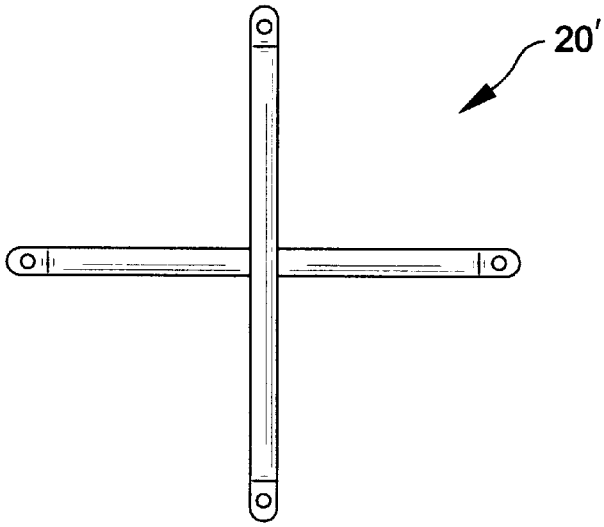
FIG. 6 is a top plan view of an alternative embodiment of the protective guard formed in accordance with the present invention.

Referring to FIGS. 2 and 5, the protective guard 20 has a substantially convex shape and is positioned perpendicular to the axis of the halogen bulb 16. The protective guard 20 may take any shape or form, e.g., a cage, as opposed to a single bar as shown in FIG. 5. The protective guard 20 will prevent a person from reaching up into the bowl portion of the lamp and possibly coming in direct contact with an extremely hot halogen bulb. Additionally, should something be placed over the shade 6, the protective guard 20 will keep such articles from directly contacting the halogen bulb. The protective guard 20 of the present invention provides the desired safety feature while obstructing the minimal amount of light produced by the lamp. Preferably, the protective guard formed in accordance with the present invention is made from a metal wire having mounting holes formed at opposite ends thereof. Machine screws 24 may be used to attach the protective guard to the edges of the reflector housed within the lamp shade 6. As previously noted, the protective guard may take the form of an open wire cage (not shown) to provide even more protection against possible contact with a potential burn hazard. As illustrated in FIG. 6, the protective guard, i.e., protective guard 20', may be formed from two wires crossed in the middle.

Figure 3:
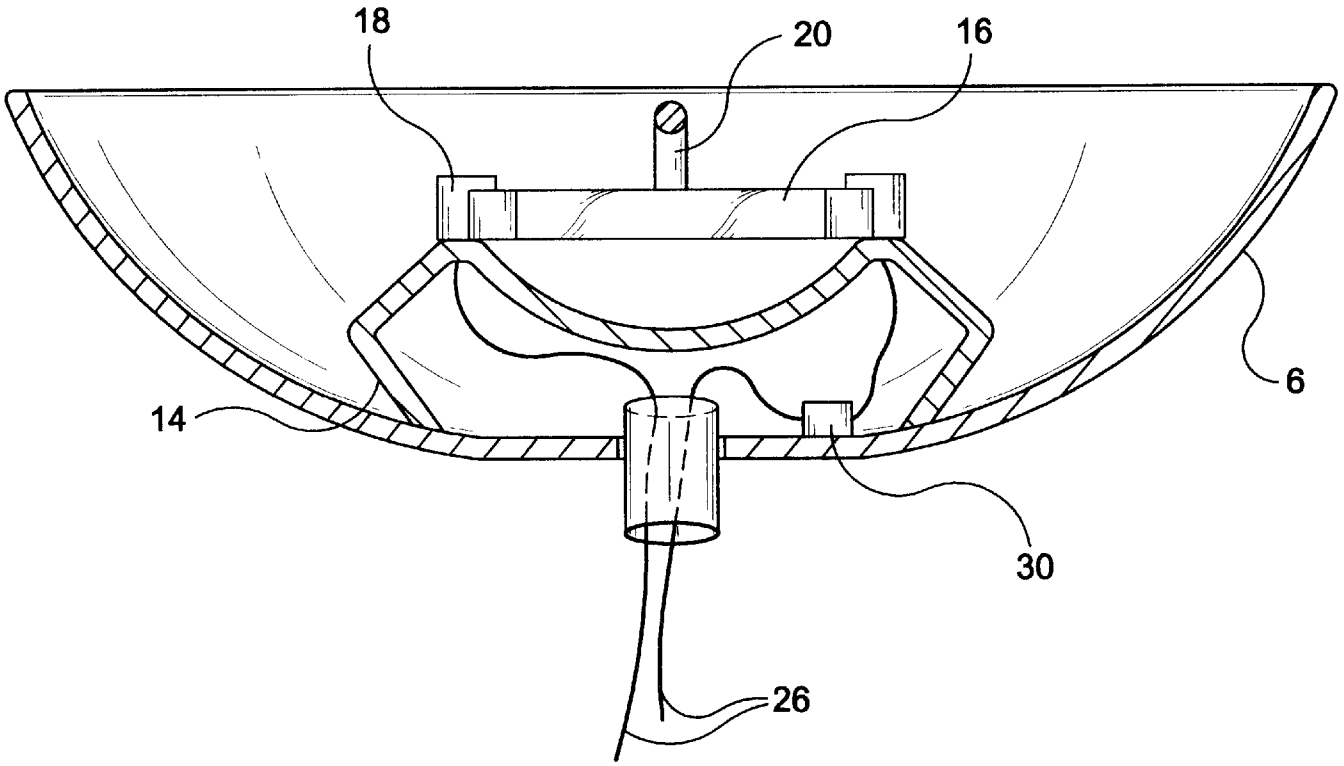
FIG. 3 is a cross-sectional view of the shade portion of the standing floor lamp formed in accordance with the present invention.

FIG. 3 is a cross-sectional view of the top shade portion 6 formed in accordance with the present invention. As illustrated in FIG. 3, the reflector 14 is mounted to a lower surface of the shade 6. The reflector includes positioned therein the sockets 18 for receiving a halogen bulb 16. Also illustrated in FIG. 3 is protective guard 20 which extends over the bulb mounted in the sockets.

The present invention is directed toward safety features for torchiere type halogen lamps. Accordingly, a torchiere lamp formed in accordance with the present invention includes a thermostat switch to prevent overheating of the lamp and a possible fire hazard. The thermostat switch 30, as illustrated in FIG. 3, is located in close proximity to the halogen bulb, namely, the area between the reflector 14 of the lamp and the metal shade 6.

Figure 4:
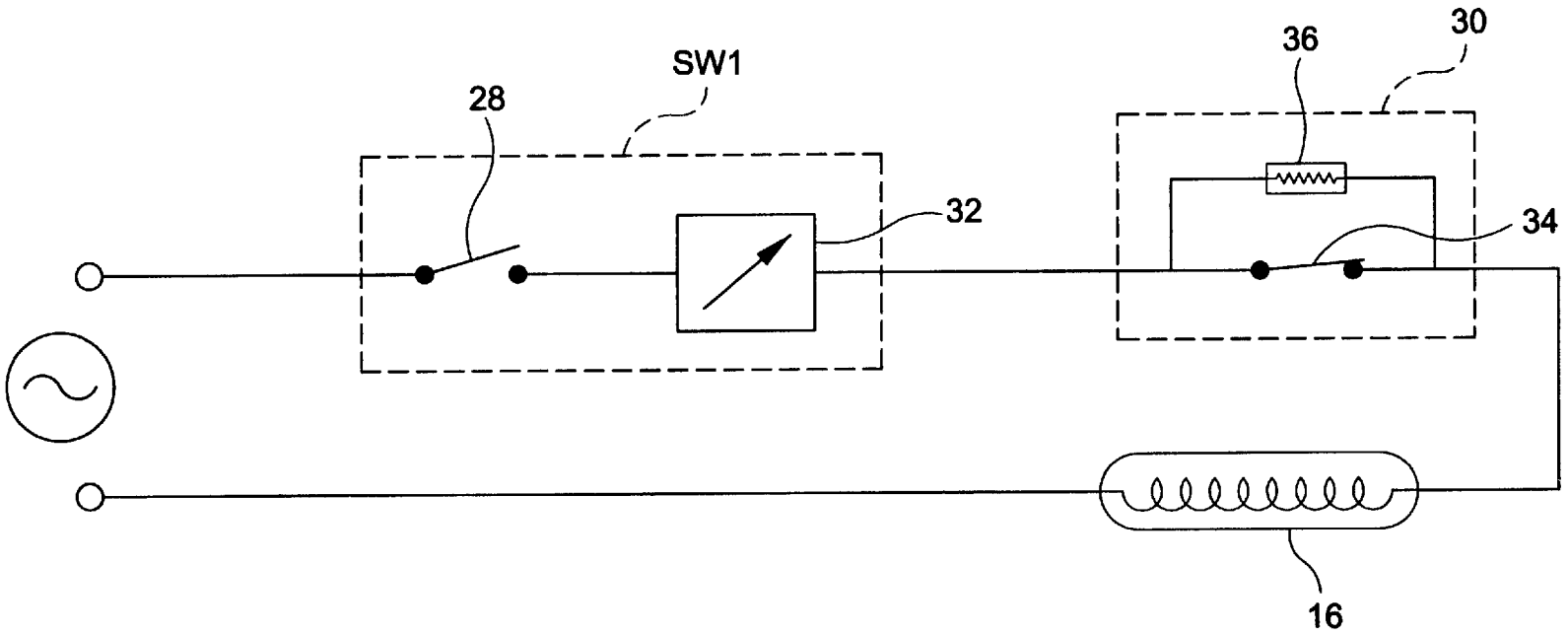
FIG. 4 is an electrical schematic of the circuit associated with the lamp formed in accordance with the present invention.

FIG. 4 is a circuit diagram for the torchiere lamp formed in accordance with the present invention. The circuit includes a power source for providing AC power to the lamp. The power source is connected in series with a switch SW1 which includes an on/off switch 28 in combination with a dimmer switch 32 so that the intensity of the light may be varied from a dim glow to a high intensity. Any known dimmer switch circuitry may be used. For example, a dimmer circuit using a triac has proven to work well in rotary on/off switches, used for lighting fixtures. In normal operation, the switch SW1 will control the intensity of the illumination from the lamp.

To provide the safety feature of the lamp formed in accordance with the present invention, a thermostat is connected in series between the switch SW1 and the socket 18 for the halogen bulb 16. Preferably, the thermostat includes a bimetallic contact 34 and a parallel connected heating element 36. As illustrated in FIG. 3, the thermostat 30 is mounted in close proximity to the halogen bulb 16. Furthermore, as illustrated in FIG. 2, the reflector 14 includes slots formed therein so that heat is readily transferred to the area in which the thermostat is mounted. If the temperature of the ambient air surrounding the thermostat reaches a predetermined temperature based upon the rated temperature of the thermostat, the bimetallic contact will change from a short circuit to an open circuit and the voltage supply is then applied across the heating element 36. Preferably, the heating element is a ceramic element which has been heated by the ambient air and, upon current being applied to the element, generates sufficient heat to maintain the bimetallic contact in an open position until power to the lamp is disconnected by either turning the switch to the off position or unplugging the lamp. Only power disruption will allow the ceramic heating element to cool down and permit the bimetallic element to return to a closed position thus allowing the lamp to operate under normal conditions again. Preferably, the ceramic heating element is a limiting resistor so that current is limited to only the current necessary to maintain the bimetallic contact in an open position. This limited current will not be sufficient to illuminate the halogen bulb.

It will be understood by those of ordinary skill in the art that the thermostat may take many forms. However, in the preferred embodiment, to provide for extra safety, a thermostat which cannot reset until power to the lamp is disconnected is most desirable. Such a thermostat is manufactured by Micro Therm under part no. A71C65-5. In the preferred embodiment, the predetermined temperature for the bimetallic contact to open is 65° C. Furthermore, the time required for the ceramic element to cool and the bimetallic contact to once again reset and close is preferably a sufficient amount of time to allow the entire lamp assembly to cool down, i.e., approximately 10 minutes. Once the bimetallic contact has reset to a closed condition and the ceramic heating element has been allowed time to cool, the lamp will be able to operate under normal conditions.

Generally, overheating conditions occur if an obstruction to the air flow occurs in the area of the shade 6 thus causing the temperature to rise to an unacceptable level. For example, a curtain or other drapery may be in close proximity to a torchiere lamp similar to that formed in accordance with the present invention. Due to the extremely high temperatures generated by a 300 watt halogen bulb, it is possible that the drapery may ignite causing a fire. The present invention including a circuit having a thermostat to terminate power to the lamp upon ambient air temperature around the lamp reaching a predetermined set point, provides greater safety and substantially eliminates any fire hazard. Accordingly, the halogen torchiere lamp formed in accordance with the present invention overcomes the disadvantages of prior art lamps and provides greater safety to the consumer. These safety features include both the thermostat cutoff as well as the protective guard positioned above the halogen lamp to prevent possible injury caused by burns due to the heat generated by a 300 watt halogen lamp.

Figure 7:
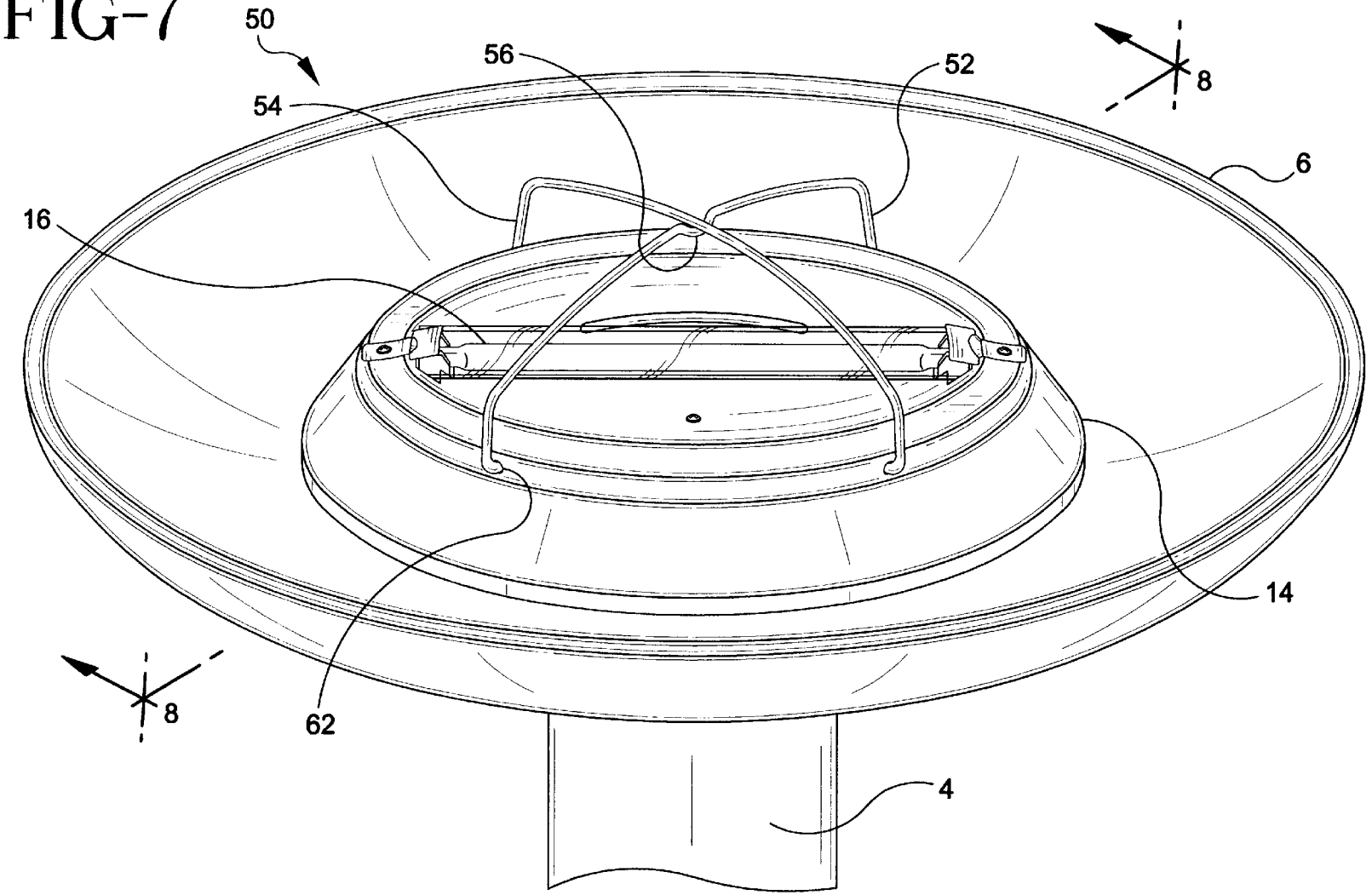
FIG. 7 is a perspective view of still another alternative embodiment of the present invention.

In one particularly preferred embodiment, the protective guard, i.e., protective guard 50 shown in FIG. 7, includes a pair of elongate intersecting wire members, i.e., lower wire member 52 and upper wire member 54, which each span from one side of reflector 14 to other side, thus forming an X-shaped dome structure which obstructs access to the halogen bulb by such objects as drapes and curtains without significant blockage of light. Wire members 52, 54 are preferably spaced 90° apart from one another about the upper periphery of reflector 14. Of course, it is contemplated herein that the protective guard could employ more than two wire members. It is also contemplated that the members of the protective guard could be secured to the shade, rather than the reflector.

Figure 8:
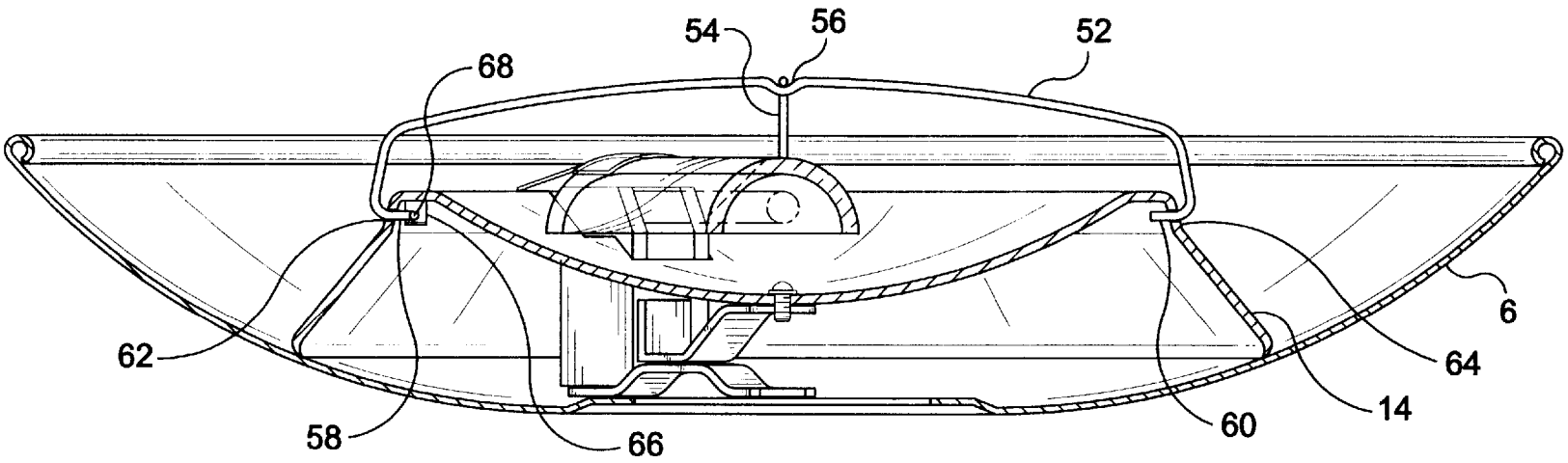
FIG. 8 is a cross-sectional view taken along lines 8—8 of FIG. 7.

As best shown in FIG. 8, wire member 52 includes a U-shaped detent 56 formed at the center thereof. The U-shaped detent is sized to receive wire member 54 therein. As will be appreciated by those skilled in the art, wire member 54, once captured within U-shaped detent 56, is substantially locked in an upright, vertically oriented position, i.e., it is unable to rotate about the reflector. Each of the wire members preferably has an arch-like configuration to enhance the structural rigidity of the resultant protective guard structure. As a result of both the U-shaped detent and the arch-like configuration of the members, the protective guard structure (as shown in FIGS. 7 and 8) is able to withstand varying loads and/or forces without failure.

As will be appreciated by those skilled in the art, it is desirable that the protective guard be installed at the factory, leaving little or no assembly left for the end user upon unpackaging of the lamp. Although protective guards such as protective guard 20 provide the required degree of protection, the rigid non-rotatable members employed in such structure either 1) require that the structure be assembled by the purchaser after unpackaging the lamp or 2) require its own unique packaging (as compared to packaging for lamps without such guard structures). However, it has been discovered herein that protective guard 50 can be installed on the lamp at the factory and still be packaged in the same packaging used for lamps without such guard structures.

More particularly, wire members 52, 54 are rotatably attached at their opposing ends to reflector 14. As best shown in FIG. 8, each of the wire members includes inwardly-directed fingers which extend through a pair of opposing openings formed in the reflector. By way of illustration, member 52 includes fingers 58, 60 which extend through opposing circular openings 62, 64 formed in the upper portion of the reflector. The wire members are sufficiently flexible as to allow attachment of such members to the reflector. Once attached, the wire members can be rotated about the circular openings through a substantially 180° arc. As mentioned above, wire member 52, 54 could alternatively be attached to the shade.

Figure 9:
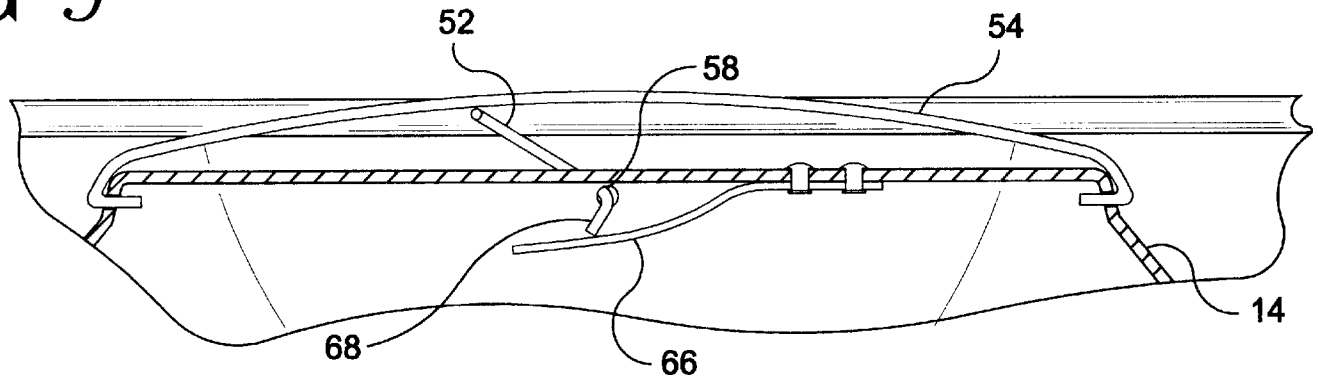
FIG. 9 is a detail in partial section of the protective guard in a collapsed position to facilitate packaging of the lamp.
Figure 10:
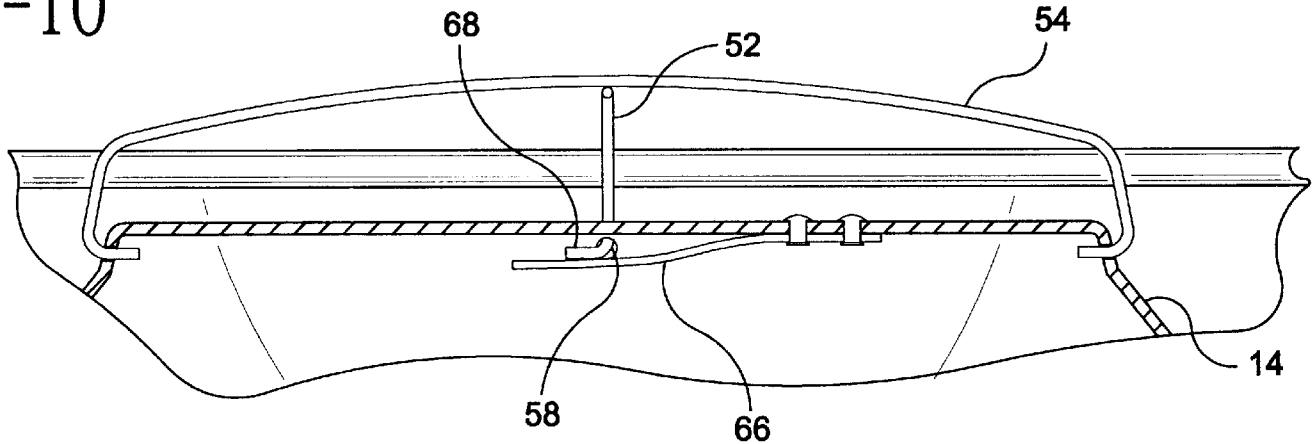
FIG. 10 is a detail in partial section of the protective guard in an upright unpackaged position.

As discussed further hereinbelow, wire member 52 is preferably biased to an upright, vertically oriented position. Referring to FIGS. 9–10, this may be accomplished by securing a resilient biasing member, i.e., spring clip 66, to the reflector 14. As shown, wire member 52 includes a leg 68 extending perpendicular from finger 58. Leg 68 of wire member 52 acts against the resilient member when the wire member 52 is pivoted to a collapsed state (as shown in FIG. 9). This collapsed state allows such lamps to be packaged in the same packaging as lamps without protective guard structures installed thereon.

Upon release of the collapsed protective guard structure, the resilient biasing member 66 acts against leg 68, thereby urging wire member 52 to its upright position. As wire member 52 is urged to its upright position by the biasing member 66, wire member 54 (which is resting against wire members 52 as shown in FIG. 9) is simultaneously caused to rotate towards its upright position until such time as wire member 54 becomes captured within the U-shaped detent 56 formed in wire member 52. Once wire member 54 is captured in U-shaped detent 56, the protective guard structure becomes locked in the X-shaped dome structure best seen in FIG. 7.

Figure 11:
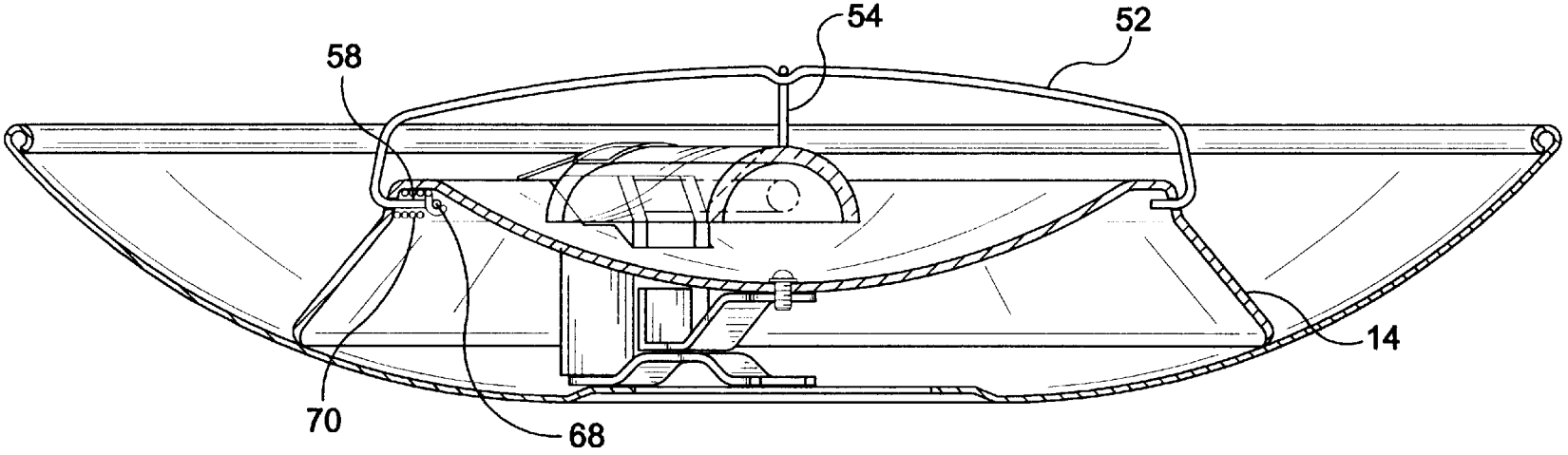
FIG. 11 is a view similar to FIG. 8 of a further embodiment of the present invention.

Of course, other types of springs may be used to bias the wire member 52 to its upright position. For example, a coil spring 70 (as shown in FIG. 11) could be secured on one end to leg 68 and on the other end to reflector 14. Additionally, springs could be attached to both sides of wire member 52, and/or could be attached to one or two sides of wire member 54.

Figure 12:
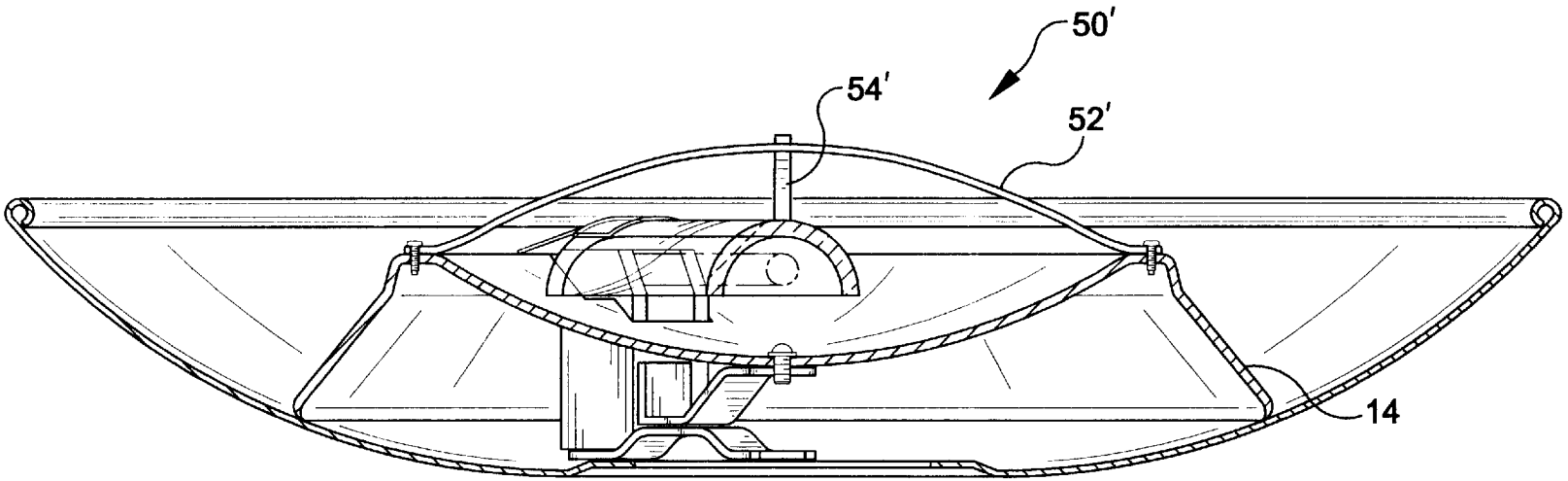
FIG. 12 is a view similar to FIG. 8 of a still further embodiment of the present invention.
Figure 13:
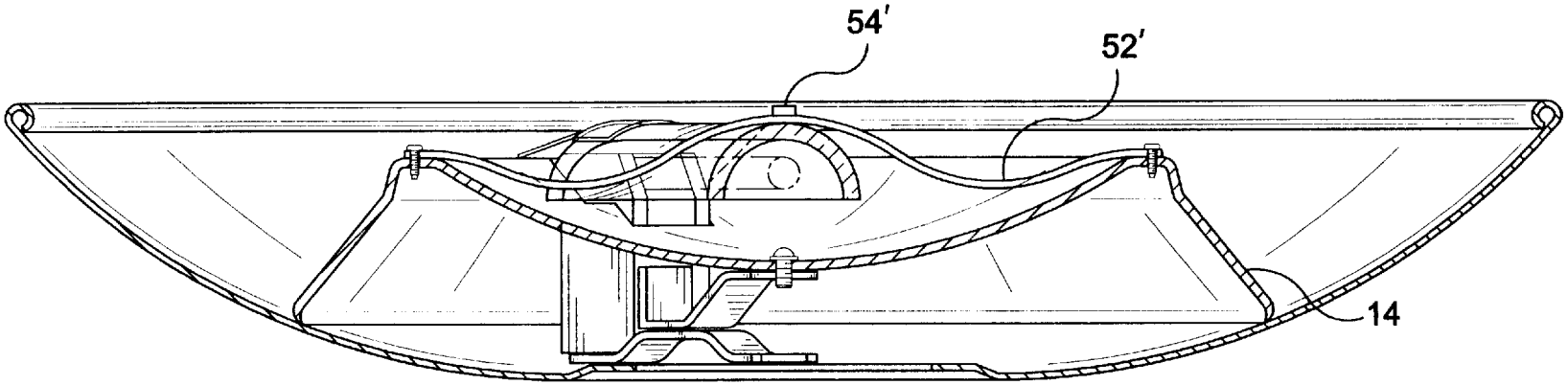
FIG. 13 is a view of the embodiment of FIG. 12 wherein the guard members have been collapsed for packaging.

In an alternative embodiment, the protective guard structure includes guard members which are permanently fastened to opposing sides of reflector 14 (or alternatively to the shade), but are sufficiently flexible as to allow collapsing thereof for packaging. As shown in FIG. 12, the protective guard structure, i.e., protective guard 50', includes resilient guard members 52', 54'. Guard members 52', 54' are attached to the reflector by, for example, sheet metal screws. Because the guard members are formed from a resilient material, they may be collapsed (as shown in FIG. 13) for packaging of the lamp. Once unpackaged, the resilient guard members return to the dome configuration of FIG. 12, thus providing a protective guard structure which obstructs access to the halogen bulb while minimizing obstruction of light from the bulb.

Figure 14:
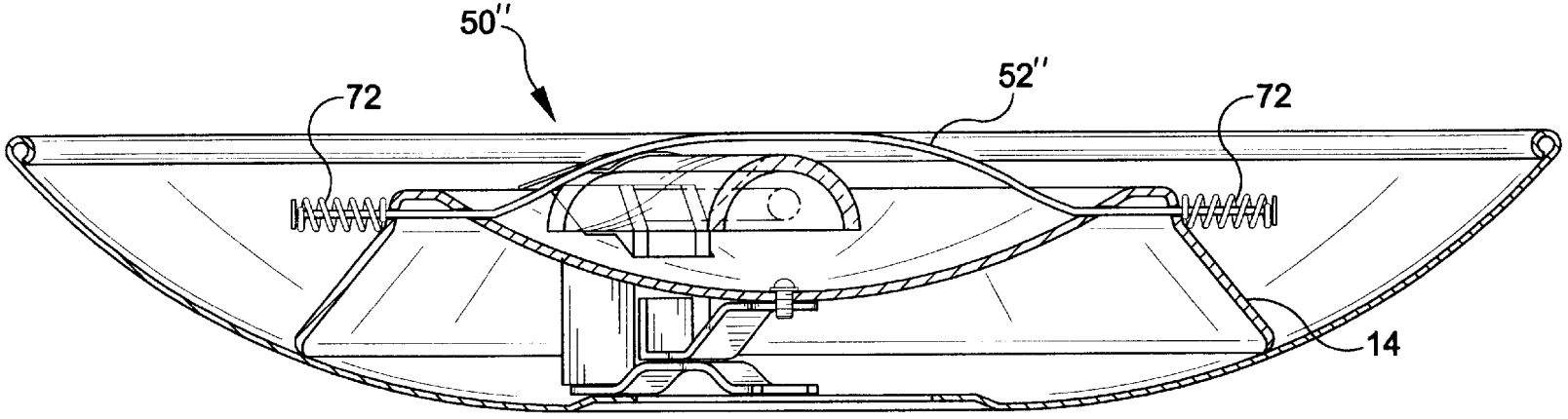
FIG. 14 is a view similar to FIG. 8 of yet another embodiment of the present invention.

In a still further embodiment, the protective guard structure, i.e., protective guard 50", is attached to reflector 14 (or alternatively to the shade) in a manner which allows the ends of the guard member to slide through openings formed in the reflector, thus allowing the guard members to be collapsed for packaging. Referring to FIG. 14, the ends of guard member 52" extend through a pair of opposing openings formed in reflector 14. The guard members of protective guard 50" are formed of a material sufficiently flexible as to allow the guard member to be collapsed for packaging (the collapsed position being illustrated in FIG. 14). The member(s) is, of course, biased (by, for example, coil springs 72) to return to an upright, non-collapsed position upon unpackaging of the lamp.

As a result, a collapsible guard structure is provided which may be installed on the lamp at the factory and thereafter collapsed to allow for packaging of the lamp. Upon unpackaging of the lamp by the end user, the spring-loaded guard structure automatically returns to its initial configuration without any involvement by the end user, thus providing a protective dome-shaped structure which obstructs access to the halogen bulb while minimizing obstruction of light from the bulb.

It will be readily apparent to one skilled in the art, and envisioned to form part of the invention to use similar components, although not necessarily identical to those described in the preferred embodiment to provide the safety features discussed herein. Specifically, many different types of thermostats may be used as well as many types of designs for the protective guard.

Although, illustrative embodiments of the present invention have been described herein with reference to the accompanying drawings, it is to be understood that the invention is not limited to those precise embodiments, and that various other changes and modification may be effected therein by one skilled in the art without departing from the scope or spirit of the invention.

What is claimed is:

1. A halogen torchiere floor lamp comprising:

a base for supporting said lamp;

an elongated stem having a first end coupled to the base and a shade coupled to the second end;

a light socket positioned within the shade for receiving a halogen bulb;

an electrical circuit for providing power to the lamp; and a protective guard mounted within an interior portion of the shade, the protective guard being positioned over at least a portion of a halogen bulb mounted within the light socket, the protective guard including at least one member rotatable between a collapsed position to facilitate packaging of the lamp and an upright position obstructing access to the light socket and bulb with minimal obstruction of light and wherein the member is resiliently biased by a spring to urge the member to an upright position when unpackaged.

2. The halogen torchiere floor lamp as defined in claim 1, wherein the at least one member is a convex-shaped wire.

3. The halogen torchiere floor lamp as defined in claim 2, further including a reflector located in a bottom portion of the shade and wherein the protective guard is mounted to opposite edges of the reflector.

4. The halogen torchiere as defined in claim 1, wherein said protective guard comprises a pair of intersecting elongate wire members.

5. The halogen torchiere as defined in claim 4, wherein said wire members include upper and lower members, and wherein said lower member is biased to said upright vertically-oriented position, and wherein said upper member is configured to rest against said lower member in said collapsed position whereby rotation of said lower member from said collapsed position to said upright vertically-oriented position simultaneously causes said upper wire member to rotate to said upright vertically-oriented position.

6. The halogen torchiere as defined in claim 5, wherein said lower member includes a centrally-disposed U-shaped detent for receipt of said upper wire member therein.

7. The halogen torchiere as defined in claim 1, further comprising:

a reflector located in a bottom portion of the shade; and a spring clip secured to said reflector for biasing said at least one member to the upright position.

8. The halogen torchiere as defined in claim 1, further comprising a reflector located in a bottom portion of the shade; and a coil spring secured to the at least one member for biasing said at least one member to the upright position.

9. The halogen torchiere as defined in claim 1, wherein said protective guard comprises at least one resilient guard member.

10. The halogen torchiere as defined in claim 9, further comprising a reflector located in a bottom portion of the shade, and wherein the ends of said resilient guard members are secured to opposing sides of said reflector, the resilient guard members being bendable to a collapsed position when packaged and return to an upright position when unpackaged.

11. The halogen torchiere as defined in claim 9, further comprising a reflector located in a bottom portion of the shade, and wherein the ends of said resilient guard members are movably attached to said reflector.

12. The halogen torchiere as defined in claim 11, wherein said reflector includes a pair of opposing openings formed in the upper periphery thereof, and wherein said ends movably extend through said openings to allow said resilient guard members to be collapsed for packaging.

13. A halogen torchiere floor lamp comprising:

a base for supporting the lamp;

an elongated stem having a first and coupled to the base and a shade coupled to the second end, the shade including a reflector with an interior thereof;

a light socket positioned within the shade for receiving a halogen bulb; and a protective guard mounted within the interior of the shade, the protective guard comprising at least a pair of members rotatable between a collapsed position to facilitate packaging of the lamp and an upright position whereby the members obstruct access to the light socket and bulb, at least one of the members having a spring secured to an end thereof for urging said member to the upright position when unpackaged.

14. A halogen torchiere as defined in claim 13, wherein said members include upper and lower members, and wherein the lower member is biased by the spring to be urged to the upright position, and further wherein the upper member is configured to rest against the lower member in the collapsed position whereby rotation of the lower member from the collapsed position to the upright position simultaneously causes the upper member to rotate to the upright position.

15. A halogen torchiere floor lamp comprising:

a base for supporting the lamp;

an elongated stem having a first end coupled to the base and a shade coupled to the second end;

a light socket positioned within the shade for receiving a halogen bulb; and a protective guard mounted within the interior of the shade, the protective guard comprising at least one resilient guard member being bendable to a collapsed position to facilitate packaging and automatically returning to an upright position when unpackaged.

* * * * *